US006572034B1

(12) United States Patent
Liu

(10) Patent No.: US 6,572,034 B1
(45) Date of Patent: Jun. 3, 2003

(54) STRUCTURE FOR A SPRAY GUN

(76) Inventor: Horng-Hsiang Liu, No. 8, Lane 45, Che Lu Tou St., San Chung City, Taipei Hsien (TW)

( * ) Notice: Subject to any disclaimer, the term of this patent is extended or adjusted under 35 U.S.C. 154(b) by 0 days.

(21) Appl. No.: 10/272,953

(22) Filed: Oct. 18, 2002

(51) Int. Cl.[7] ..... B05B 15/06

(52) U.S. Cl. ..... 239/531; 239/525; 239/375; 239/376; 239/377; 239/378; 239/379

(58) Field of Search ..... 239/531, 375, 239/376, 377, 378, 379, 525

(56) References Cited

U.S. PATENT DOCUMENTS 6,092,740 A * 7/2000 Liu ..... 239/378

* cited by examiner

*Primary Examiner*—Robin O. Evans
(74) *Attorney, Agent, or Firm*—Rosenberg, Klein & Lee

(57) ABSTRACT

The structure of a spray gun of the present invention is basically composed of a hook, a pin, a spray gun and a retaining ring. The top portion of the spray gun has a trough to receive the hook therein. The trough has a connecting ridge at one end with a through hole at the center portion thereof. The hook comprises a hole at one end, in correspondence to the through hole of the connecting ridge, and is secured by inserting a pin through the hole of the hook and the through hole of the connecting ridge, this allows the hook to change its angle position with respect to the trough.

1 Claim, 5 Drawing Sheets

STRUCTURE FOR A SPRAY GUN

FIELD OF THE INVENTION

This invention relates to a spray gun, more particularly to a spray gun with a hook to adjust angle position of the paint can.

BACKGROUND OF THE INVENTION

Spray guns were derived at a long time ago to help people simplify their painting job, and the prior art, as shown in FIG. 5 mostly is formed a hook A1 on top of the spray gun A, which is adapted to hang the spray gun at fixed place when not in use. The hook A1 is normally located on the top position close to a threaded opening A2, which is formed in an inclined position and is adapted to connect with a paint can B. The paint can B is a consuming product, which can't mix with other colors, therefore, it requires to replace with various paint cans B. However, different paint can makers have different sizes of the can itself and of connectors B1. When using a paint can B with a shorter connecting ridge B1, the barrel of the paint can B will encounter with the hook A1 and make the installation difficulty.

An extension plug were later applied to connect, the connector B1 of the paint can B with the opening A2, so as to avoid encounter of the paint can B and the hook A1, however, this devise produces an imbalance and is hard to hold tight for a certain period of time.

In view of the above-mentioned shortcomings, the inventor has derived the present invention.

SUMMARY OF THE INVENTION

It is the primary object of the present invention to provide a renovated structure for a spray gun, which has a hook being able to adjust its position so as to avoid blocking the paint can at the right position of the spray gun.

It is another object of the present invention to provide a renovated structure for a spray gun, which is easy to operate.

It is a further object of the present invention to provide a renovated structure for a spray gun, which is designed to fit paint cans of different makers.

DETAILED DESCRIPTION OF THE PREFERRED EMBODIMENT

Figure 1:
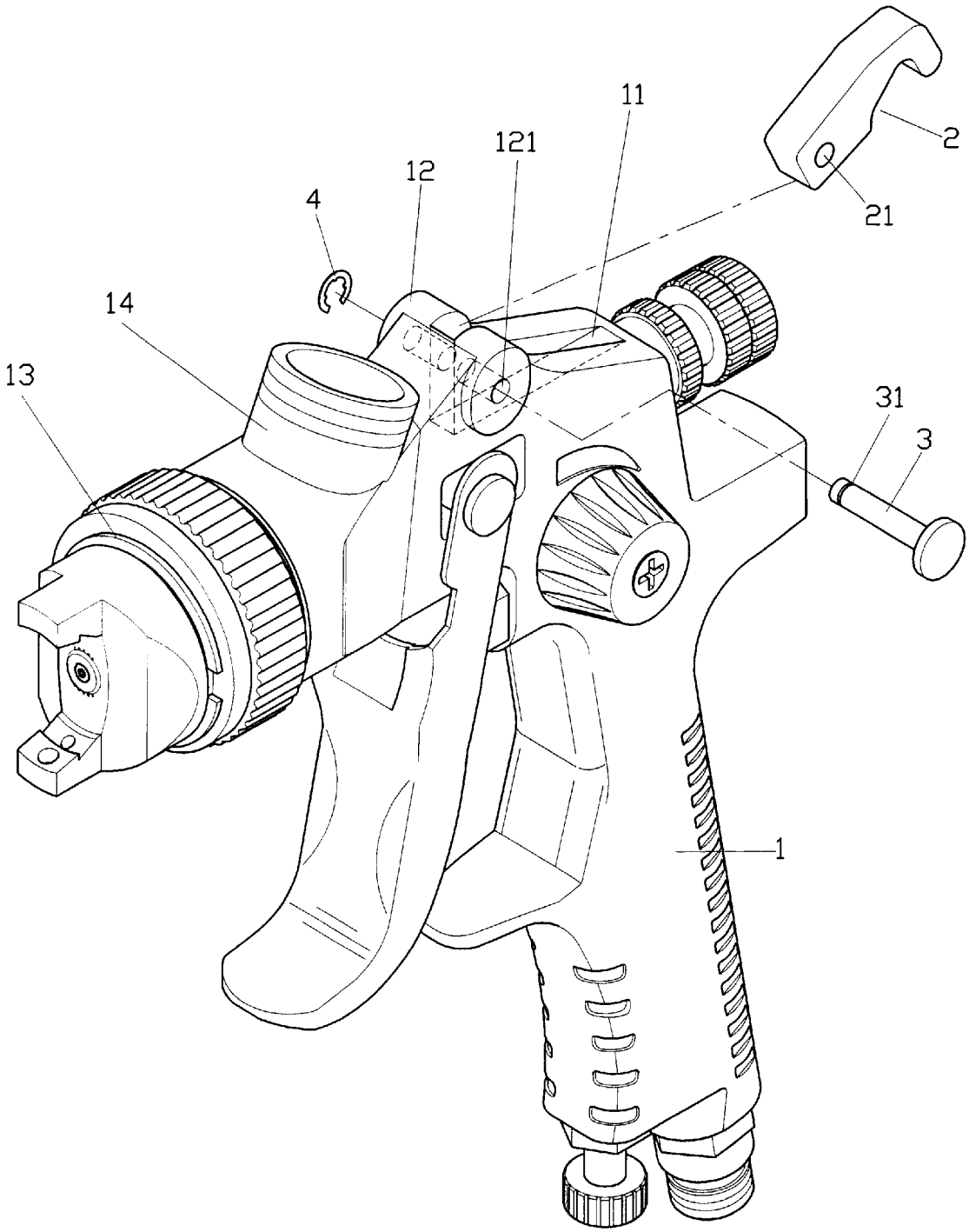
FIG. 1 is a perspective view of the present invention.

The renovated structure of the present invention, as shown in FIG. 1, comprises a spray gun 1, a hook 2, a pin 3, and a retaining ring 4.

The spray gun 1 has a trough 11 at top portion. The trough 11 has a connecting ridge 12 protruding from one end with a through hole 121 at the center portion thereof. The spray gun has an opening 14 with threads inside on top portion near a nozzle 13. The opening 14 is in an inclining direction towards the rear end of the spray gun 1.

The hook 2 is a block with a through hole 21 at one end.

Figure 2:
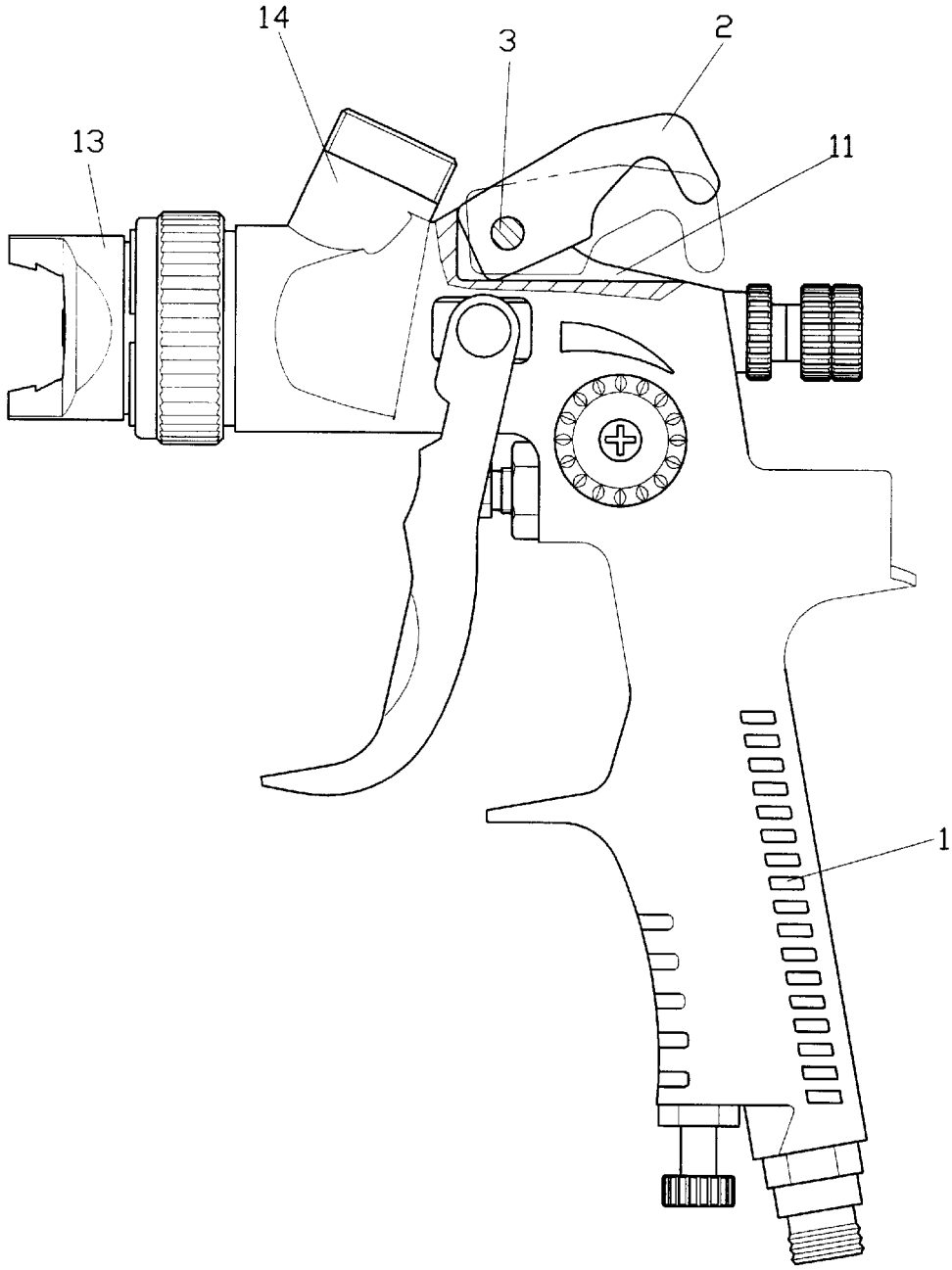
FIG. 2 is a side sectional view of the present invention.

To assemble the present invention, referring to FIG. 2, the hook 2 is placed into the trough 11 with the hole 21 in align with the through hole 121 of the connecting ridge 12, and the pin 3 is inserted through there from one end and fastened by the retaining ring 4 at the other end on a trough 31 of the pin 3. The hook 2 at this moment is adjustable at its position in the trough 11.

Figure 3:
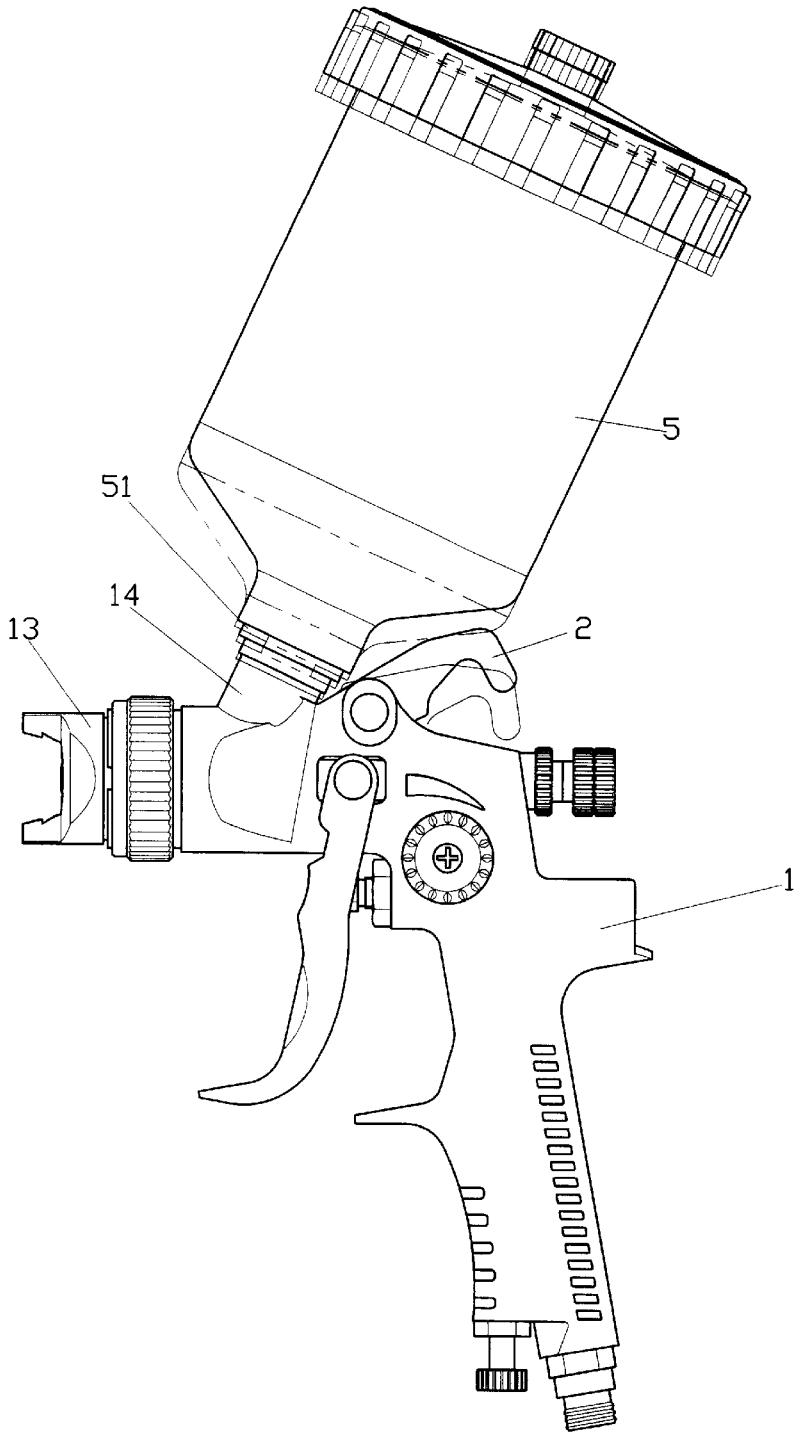
FIG. 3 is a side view showing a hook of the present invention in a first position.
Figure 4:
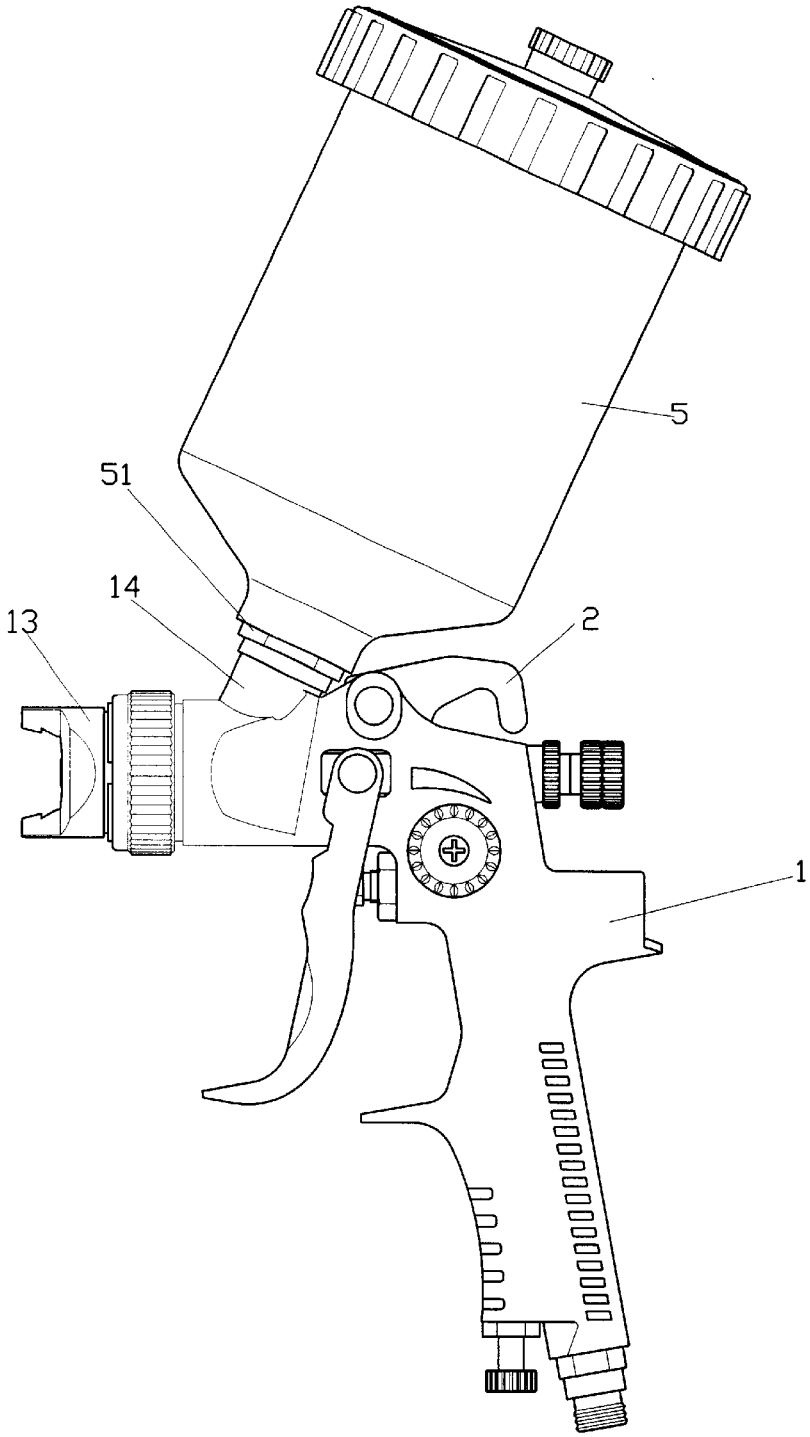
FIG. 4 is a side view showing the hook of the present invention in a second position.
Figure 5:
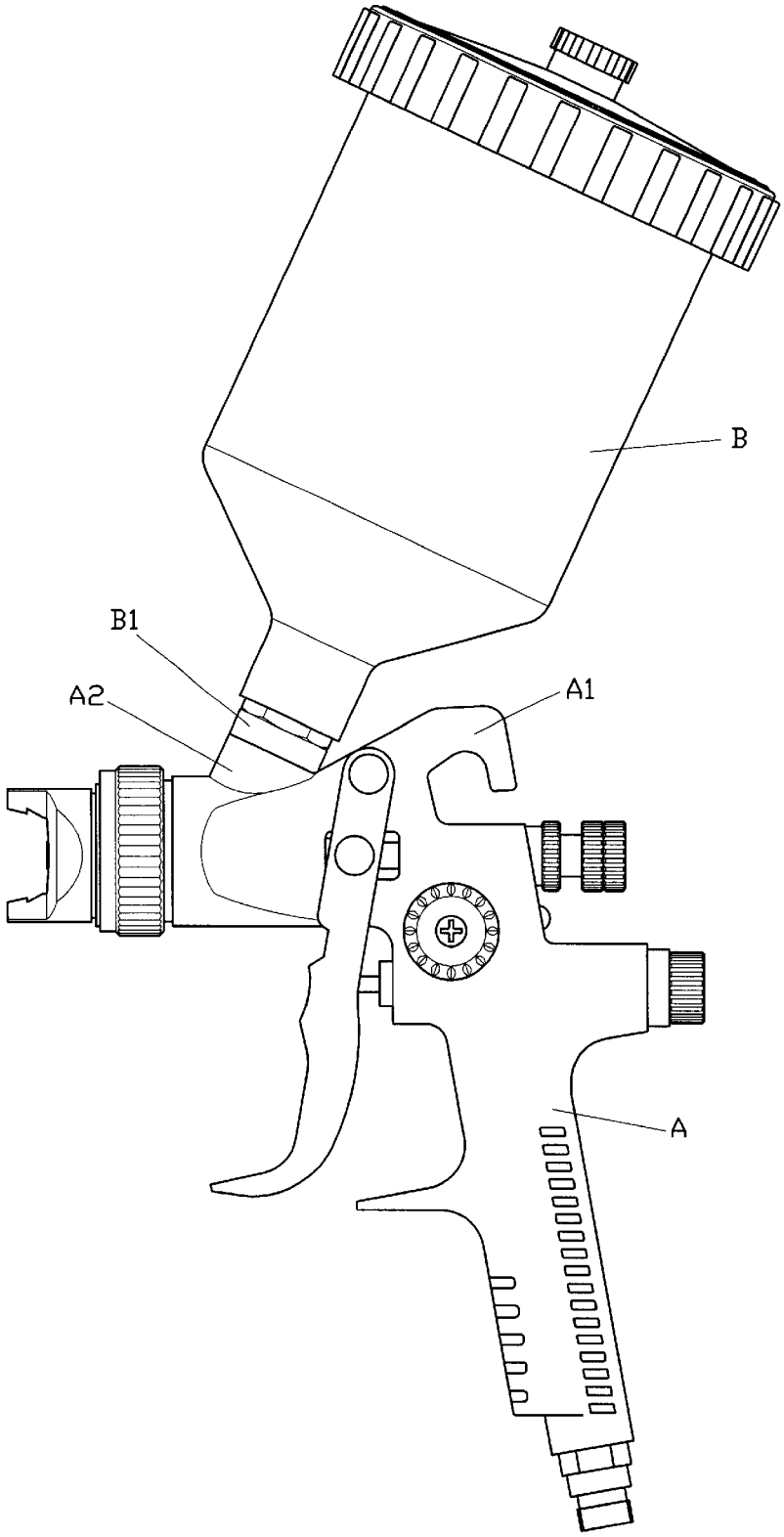
FIG. 5 (PRIOR ART)
FIG. 5 is a side view of a spray gun of a prior art.

Installation of a paint can 5 is shown in FIG. 3, which aligns a neck 51 of the paint can 5 to the opening 14, whereas the hook 2 remains a distance from the paint can 5, thus will not interfere with the job. Regardless of the neck 51 of the paint can 5 is short or long, the adjustment of the hook 2 may always be the proper position for a user to work at the most convenient, as shown in FIG. 4.

I claim:

1. A spray gun structure comprising a spray gun body having a nozzle at a front end thereof and an inlet opening inclined toward a rear end of said spray gun body and disposed adjacent said nozzle, said spray gun body having a connecting ridge formed on an upper end thereof adjacent said inlet opening with a trough extending toward said rear end of said spray gun body from within said connecting ridge, said connecting ridge having a hole formed therethrough and in open communication with said trough; a paint container having a outlet coupled directly to said inlet opening; a hook pivotally disposed in said trough and having a block formed at one end thereof, said block having a through hole formed therein disposed in aligned relationship with said hole in said connecting ridge; a pin extending through said hole in said connecting ridge and said through hole in said block to provide a pivotal coupling between said connecting ridge and said hook, said pin having an annular groove formed in a distal end portion thereof; and a retaining ring disposed in said annular groove of said pin.

* * * * *